US009169105B2

(12) United States Patent
Urben et al.

(10) Patent No.: US 9,169,105 B2
(45) Date of Patent: Oct. 27, 2015

(54) ELEVATOR INSTALLATION WITH A MULTI-DECK VEHICLE

(75) Inventors: Andreas Urben, Lucerne (CH); Marcel Nicole, Stansstad (CH); Marco Schupfer, Rifferswil (CH); Matthias Sager, Kussnacht a/Rigi (CH); Urs Schaffhauser, Root (CH)

(73) Assignee: Inventio AG, Hergiswil (CH)

( * ) Notice: Subject to any disclaimer, the term of this patent is extended or adjusted under 35 U.S.C. 154(b) by 506 days.

(21) Appl. No.: 13/202,364

(22) PCT Filed: Feb. 16, 2010

(86) PCT No.: PCT/EP2010/051932

§ 371 (c)(1),
(2), (4) Date: Nov. 7, 2011

(87) PCT Pub. No.: WO2010/094686

PCT Pub. Date: Aug. 26, 2010

(65) Prior Publication Data

US 2012/0037462 A1 Feb. 16, 2012

(30) Foreign Application Priority Data

Feb. 20, 2009 (EP) ..... 09153265

(51) Int. Cl.
*B66B 1/40* (2006.01)
*B66B 11/02* (2006.01)

(52) U.S. Cl.
CPC ..... *B66B 11/0206* (2013.01); *B66B 11/022* (2013.01)

(58) Field of Classification Search
CPC ..... B66B 11/0213; B66B 11/022; B66B 1/24
USPC ..... 187/249, 291, 401, 902
See application file for complete search history.

(56) References Cited

U.S. PATENT DOCUMENTS 1,918,427 A * 7/1933 Rice ..... 187/401
1,946,982 A 2/1934 Mepeak (Continued)

FOREIGN PATENT DOCUMENTS

EP 1342690 A1 9/2003
JP 49123772 U 10/1974

(Continued)

*Primary Examiner* — William E Dondero
*Assistant Examiner* — Minh Truong
(74) *Attorney, Agent, or Firm* — Fraser Clemens Martin & Miller LLC; William J. Clemens

(57) ABSTRACT

An elevator system includes a multi-deck vehicle having at least two cars for transporting persons and/or goods, wherein the elevator system is arranged so as to be movable along a track and is coupled to a drive using at least one support device. The at least two cars of the multi-deck vehicle are coupled to each other, the track includes at least one guide rail, and each of the cars of the multi-deck vehicle has at least one guide element that is guided on or in one of the at least one guide rail.

14 Claims, 1 Drawing Sheet

(56) References Cited

U.S. PATENT DOCUMENTS

| | | | | |
|---|---|---|---|---|
| 5,907,136 | A * | 5/1999 | Hongo et al. | 187/277 |
| 6,161,652 | A * | 12/2000 | Kostka et al. | 187/291 |
| 6,786,305 | B2 | 9/2004 | Kamimura et al. | |
| 6,802,396 | B2 * | 10/2004 | Naitoh | 187/401 |
| 6,857,507 | B2 * | 2/2005 | Gallati et al. | 187/284 |
| 7,017,714 | B2 * | 3/2006 | Fujita et al. | 187/267 |
| 2007/0221453 | A1 * | 9/2007 | Windlin et al. | 187/373 |
| 2008/0173503 | A1 * | 7/2008 | Schupfer | 187/401 |
| 2009/0250297 | A1 * | 10/2009 | Brun | 187/291 |
| 2011/0042168 | A1 * | 2/2011 | Grundmann | 187/249 |
| 2012/0111671 | A1 * | 5/2012 | Yamada et al. | 187/249 |

FOREIGN PATENT DOCUMENTS

| | | | |
|---|---|---|---|
| JP | 6156951 | A | 6/1994 |
| WO | 9809906 | A1 | 3/1998 |
| WO | 2005014460 | A1 | 2/2005 |

* cited by examiner

ELEVATOR INSTALLATION WITH A MULTI-DECK VEHICLE

FIELD OF THE INVENTION

The present invention relates to an elevator installation with a multi-deck vehicle, which comprises at least two cars for transporting persons and/or goods and which is movable with the help of a drive and a support means along guide rails.

BACKGROUND OF THE INVENTION

Such multi-deck vehicles of elevator installations conventionally include a common car frame, in which at least two cars are integrated and which is arranged to be movable or displaceable along guide rails in an elevator shaft. This common car frame is coupled by way of a support means with a drive and optionally also with a counterweight.

Multi-deck vehicles of that kind are known from, for example, the documents EP 1 342 690 A1, U.S. Pat. No. 6,786,305 B2, WO 98/09906 A1 and WO 2005/014460 A1. In the multi-deck vehicles disclosed in these documents in each instance different devices for changing a spacing between adjacent cars and/or adjusting a floor of a car are provided, so that these multi-deck vehicles can be used in elevator shafts with different floor spacings or in an elevator shaft with variable or imprecise floor spacings.

SUMMARY OF THE INVENTION

The invention has an object of providing an elevator installation of the kind stated in the introduction with an improved multi-deck vehicle which is simpler and more economic to produce and which offers an increased level of travel comfort.

The elevator installation comprises a multi-deck vehicle with at least two intercoupled cars for transporting persons and/or goods, wherein the multi-deck vehicle is movable with the help of a drive and a support means along guide rails. In that case guide elements are mounted at each of the cars of the multi-deck vehicle and guide the respectively associated car at the guide rails.

By contrast with conventional elevator installations with a multi-deck vehicle, in the multi-deck vehicle of the elevator installation according to the invention a common car frame is not provided, but the individual cars of the multi-deck vehicle are guided in each instance in their at least one guide plane directly at the guide rails of the elevator installation. The overall construction of such a multi-deck vehicle has a lower weight and can be produced more simply as well as installed more easily. Moreover, the multi-deck vehicle according to the invention has an improved vibration behavior, since by contrast with conventional elevator installations with a first movement system between cars and car frame and a second movement system between car frame and guide rails only a single movement system is present between the cars and the guide rails and a vibration coupling between the individual cars via the common car frame is eliminated. In addition, the large and heavy additional components, which are disadvantageous with respect to vibration behavior, of the common car frame are eliminated.

Advantageously, the at least two cars of the multi-deck vehicle are connected together by a coupling device which is constructed in such a manner that forces, which are directed by the coupling device exclusively substantially parallelly to the longitudinal axes of the guide rails, are transmissible between the cars. Such a coupling device serves the purpose of thus transmitting the supporting and drive forces from each of the cars of the multi-deck vehicle to the respectively adjacent car.

According to one of the forms of embodiment of the invention each of the cars comprises, in at least one guide plane lying at right angles to the longitudinal axes of the guide rails, guide elements which guide the car in said guide plane at the guide rails of the multi-deck vehicle.

By "guide plane" of a car there is to be understood in the present connection a plane which extends at right angles to the longitudinal axes of the guide rails and in which a group of guide elements fixed to the car is arranged, which guide elements guide—at the guide rails of the multi-deck vehicle—the region of the car lying in this guide plane, or in which an end region, which is not provided with guide rails, of a car is guided at an adjacent car.

Advantageously, each of the cars is guided in its at least one guide plane at the guide rails exclusively by the guide elements associated with this guide plane. The advantage resides particularly in the fact that a statically defined spacing of the car guidance is given for each car at any time. No undefined guidance states arise, such as is the case with multi-deck vehicles which have a rigid common guide frame guided in more than two guide planes.

Preferably at least one of the cars of the multi-deck vehicle is provided in at least two guide planes, which are spaced apart in the direction of movement of the multi-deck vehicle, with guide elements which guide the car at the guide rails in these guide planes independently of guide elements of further guide planes of the multi-deck vehicles. In the case of such a form of construction at least one of the cars is fully defined in static terms and guided at the guide rails independently of further cars of the multi-deck vehicle.

By the term "direction of movement of the multi-deck vehicle" there is to be understood in the present connection a direction of movement of the multi-deck vehicle in the direction of the longitudinal axis of the guide rails.

In an alternative embodiment at least one of the cars of the multi-deck vehicle is provided in at least two guide planes, which are spaced from one another in the direction of movement of the multi-deck vehicle, with guide rails which guide the car at the guide rails in these guide planes independently of guide elements of further guide planes of the multi-deck vehicle. At least one further one of the cars of the multi-deck vehicle is in that case guided in a first guide plane at an adjacent car of the multi-deck vehicle and is provided in a second guide plane, which is spaced from the first guide plane in the direction of movement of the multi-deck vehicle, with guide elements which guide the further car at the guide rails in its second guide plane independently of guide elements of further guide planes of the multi-deck vehicle. The advantage of such a form of embodiment resides in the fact that with regard to the further cars in each instance it is possible to dispense with a set of guide elements.

Advantageously, the coupling device comprises at least one joint by way of which it is pivotably connected with at least one of the cars of the multi-deck vehicle. With such a joint or such a pivotable connection it is achieved that the coupling device in the case of transmission of the supporting and driving forces from each one of the cars of the multi-deck vehicle to the adjacent car transmits only forces which are oriented substantially in the direction of movement of the multi-deck vehicle, i.e. in the direction of the longitudinal axis of the guide rails.

According to one of the forms of embodiment of the invention the coupling device is on a first side pivotably connected with one car and on a second side rigidly connected with the adjacent further car. It is thereby made possible to connect a guide plane of one car with the help of a coupling device with an adjacent car and thus to guide it.

Advantageously, the spacing between two cars of the multi-deck vehicle in the direction of movement of the multi-deck vehicle is settable by means of a motor-operated and controllable adjusting device integrated in the coupling device.

Such an adjusting device makes possible automatic adaptation of the spacing between the floor levels of the cars of a multi-deck vehicle to different floor spacings of a building.

According to a further form of embodiment of the elevator installation according to the invention at least one of the cars of the multi-deck vehicle has a car floor adjustable at least in a sub-region in the direction of movement of the multi-deck vehicle, wherein an adjusting movement is carried out by a motor-operated and controllable adjusting device. With this form of embodiment as well the automatic setting of the spacing between the floor levels of the cars of a multi-deck vehicle to different floor spacings of a building is made possible.

Advantageously, at least one of the cars of the multi-deck vehicle comprises a safety frame which is associated only with this car and in which a car body is mounted, wherein the guide elements associated with this car are fixed to this car frame. The installation of a car in a separate safety frame enables use of non-self-supporting car bodies with correspondingly lower inherent stability and reduced weight.

According to an alternative form of embodiment at least one of the cars of the multi-deck vehicle is constructed as a self-supporting construction, wherein the guide elements associated with this car are fastened to the self-supporting construction. With the use of self-supporting cars a simplification of the car construction as well as a reduction in the cross-section, which is demanded by the cars, of the elevator shaft result.

According to a further aspect of the invention at least one of the cars of the multi-deck vehicle is provided with at least one safety brake device.

Preferably, each of the cars of the multi-deck vehicle is provided with at least one safety brake device. In this case, the individual safety brake devices can be of simpler construction, since reduced demands are imposed thereon, because the safety function is distributed to several safety brake devices.

Advantageously, the at least one support means is so arranged that it directly supports and drives an uppermost or a lowermost car of the multi-deck vehicle, wherein the at least one further car of the multi-deck vehicle is coupled by means of the coupling device to the car supported by the support means.

DESCRIPTION OF THE DRAWINGS

The above as well as further features and advantages of the invention are more readily understandable from the following description of preferred, non-restrictive exemplifying embodiments with reference to the accompanying drawings, in which.

DETAILED DESCRIPTION OF THE INVENTION

An elevator installation according to the present invention can be constructed as an elevator for persons or the transport of persons and optionally also goods or as a goods elevator exclusively for the transport of goods. Moreover, the elevator installation according to the invention is usable in various objects such as above-ground and/or below-ground buildings, in mines or in land or water vehicles.

Figure 1:
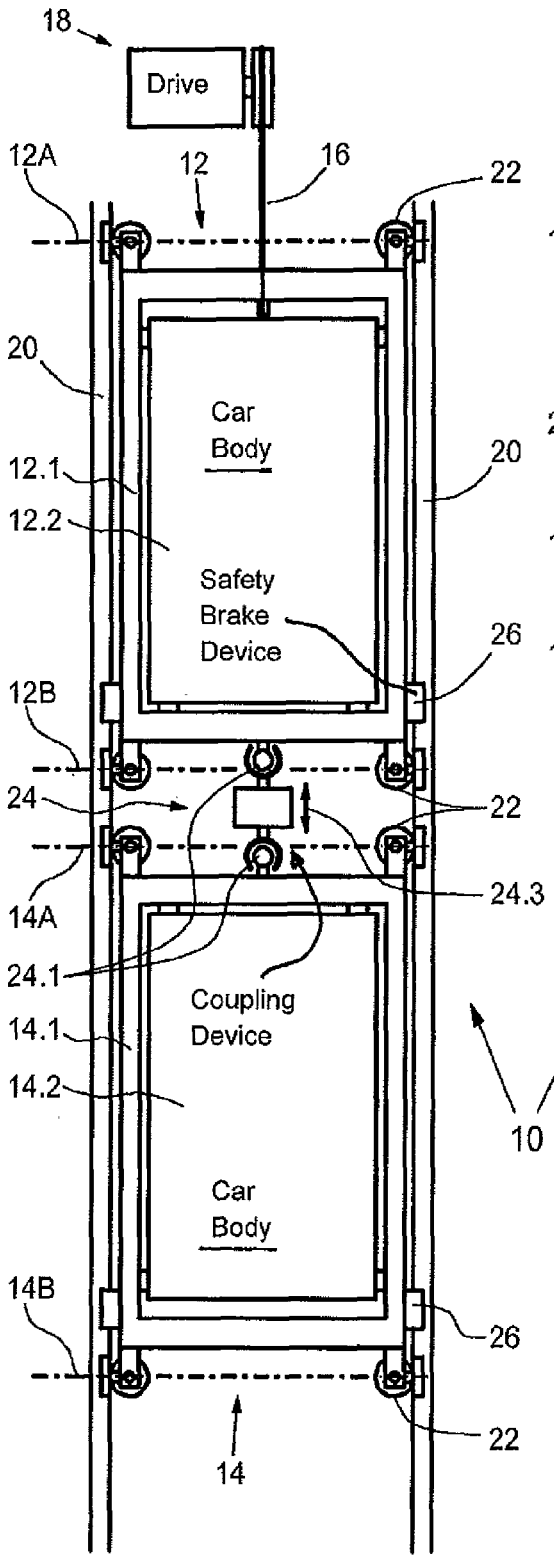
FIG. 1 shows a schematic illustration of an elevator installation with a multi-deck vehicle according to a first exemplifying embodiment of the present invention.

The elevator installation shown in FIG. 1 comprises a multi-deck vehicle 10 with two cars 12, 14, which vehicle is movable along a travel path between fixed access points (particularly between floors of a building), which are not illustrated. The multi-deck vehicle 10 comprises an upper car 12 and a lower car 14. However, within the scope of the present invention multi-deck vehicles can also comprise more than two cars and the following explanations are also applicable to such multi-deck vehicles.

The cars 12, 14 of the multi-deck vehicle 10 according to FIG. 1 are arranged vertically one above the other and are moved in vertical direction. Within the scope of the present invention the multi-deck vehicle 10 can, however, also be conceived to be movable in inclined travel paths, along a curved curve path or in a combination of the mentioned possibilities.

The multi-deck vehicle 10 is movable with the help of a support means 16 along its travel path defined by guide rails 20. The support means 16 co-operates with a drive 18 which supports and drives the support means and thus the multi-deck vehicle 10. A resiliently bendable, belt-like or cable-like support means is preferably used as the support means 16, wherein the invention is not to be restricted to a specific form of construction of the support means. In the case of the form of embodiment illustrated in FIG. 1 one end of the support means 16 is fastened directly or indirectly in the region of the car roof of the uppermost car 12 of the multi-deck vehicle 10 to this uppermost car.

The drive 18 comprises a drive engine or several drive engines, which are optionally operable independently of one another and which drive the support means or the multi-deck vehicle 10 by way of a drive pulley or a drum. However, the present invention is not to be restricted to a specific form of construction of the drive 18.

The cars 12, 14 of the multi-deck vehicle illustrated in FIG. 1 each comprise a safety frame 12.1, 14.1 which is preferably constructed as a steel frame. Integrated in these safety frames are so-termed car bodies, 12.2, 14.2 which serve for reception of passengers or goods and which comprise suitable floor, wall and ceiling constructional elements. The car bodies are in general produced with a rectangular or square plan, but other car shapes are also possible, for example those with a round or a hexagonal plan. Provided at each car 12, 14 is at least one access which in most cases is closable by an appropriate car door. The cars can be entered or loaded from the access points of the floors by way of such accesses. With respect of the construction of the individual cars 12, 14, the present invention is not restricted to specific constructional forms.

The multi-deck vehicle 10 is preferably—but not necessarily—arranged in an elevator shaft with a wall surrounding the shaft at least in sections. In a particularly preferred form of embodiment the travel path of a counterweight is also disposed in the elevator shaft near the travel path of the multi-deck vehicle 10. In another form of embodiment the counterweight is accommodated in a separate elevator shaft. Belonging to the elevator shaft in general are also a shaft head in the upper end region and a shaft pit in the lower end region in order to provide possibly desired over-travel paths and protection spaces. Buffers for the multi-deck vehicle 10 or the counterweight can, for example, be arranged in the shaft pit.

Substantially rigid guide rails for the multi-deck vehicle 10 and optionally also guide rails for the counterweight are arranged at the side walls of the elevator shaft. The guide rails 20 have the task of precisely and exactly guiding the multi-deck vehicle 10 in the travel path allocated thereto. The cars 12, 14 of the multi-deck vehicle 10 are each equipped with guide elements 22 firmly fixed to the cars or the safety frames 12.1 thereof, by which they are guided in the elevator shaft at the guide rails 20. These guide elements can be present in the form of, for example, rolling guide shoes, sliding guide shoes, magnetic guide shoes, etc. Groups of such guide elements 22 are respectively arranged at the cars 12, 14 in common guide planes 12A, 12B, 14A, 14B, which extend at right angles to the longitudinal axes of the guide rails and which in the present exemplifying embodiment are horizontal. In each guide plane the cars 12, 14 are guided at the guide rails 20 exclusively by the guide elements 22 associated with this guide plane.

In the case of the form of embodiment shown in FIG. 1 each of the two cars 12, 14 is equipped in two guide planes 12A, 12B or 14A, 14B, which are spaced from one another in the direction of movement of the multi-deck vehicle 10, by guide elements 22 which guide the cars at the guide rails 20 in the said guide planes independently of guide elements present in further guide planes of the multi-deck vehicle 10. Each of the cars 12, 14 is guided in statically defined manner in its two guide planes 12A, 12B or 14A, 14B by the guide elements 22 associated with these guide planes. Undefined or non-specific guide states and disruptive transverse oscillations, such as occur with multi-deck vehicles having a rigid common guide frame with more than two guide planes, are avoided in the elevator installation according to the invention.

In the exemplifying embodiment according to FIG. 1 the two cars 12, 14 of the multi-deck vehicle 10 are connected together by way of a coupling device 24. The two coupling points 24.1 present between the coupling device 24 and the two cars 12, 14 are constructed as pivot couplings which preferably comprise a ball joint or a Carden joint. It is thereby ensured that the coupling device transmits forces only in the direction of movement of the multi-deck vehicle 10, so that the guide elements of the first car and the guide elements of the second car do not influence one another or so that the two cars 12, 14 are guided effectively independently of one another.

According to a preferred form of embodiment of the invention the coupling device 24 is so conceived that it can effect a motor-operated, controllable adjustment of the spacing between the two adjacent cars 12, 14. In this manner the spacings between cars of the multi-deck vehicle 10 can be automatically adapted to varying floor spacings of the elevator shaft. Such a coupling device 24 can comprise an adjusting device, for example a linear setting drive, which is symbolically illustrated in FIG. 1 by the arrow 24.3. However, the invention is not to be restricted to this form of construction of an adjusting device or a coupling device.

The cars 12, 14 of the multi-deck vehicle 10 are guided directly at the guide rails 20 of the elevator shaft without a common car frame being present. The cars 12, 14 therefore hardly have to be modified relative to conventional individual cars. A large component such as the common car frame usually present in conventional multi-deck vehicles is eliminated, which significantly simplifies transport of the multi-deck vehicle 10 as well as the mounting thereof in an elevator shaft.

By virtue of the direct coupling of the cars of the multi-deck vehicle 10 to the guide rails 20 of the elevator shaft the vibration behavior is in addition improved by comparison with conventional construction with a common car frame. This is due to the fact that in the case of the system according to the invention each car is separately guided at the guide rails and a larger and heavier common car frame with low intrinsic frequency is not present. In order to further reduce the vibrations occurring in this movement system the guide rails 20 are preferably mounted in the elevator shaft by sound-damping and vibration-damping fastening elements.

Moreover, at least one of the cars 12, 14 of the multi-deck vehicle 10 is equipped with at least one safety brake device 26. Preferably, all cars 12, 14 of the multi-deck vehicle 10 are equipped with such safety brake devices. Thus, either an increased safety in the case of a required activation of the safety brake devices can be achieved or the demands on individual safety brake devices can be reduced, because the safety function is distributed to a larger number of safety brake devices 26. In the latter case, the individual safety brake devices 26 can therefore be constructed to be simpler and more economic.

The safety brake devices 26 are respectively fixedly connected with a car 12, 14 or with the safety frame 12.1, 14.1 thereof. They usually comprise a safety housing with the safety elements, transmission elements and connecting elements for triggering of the safety brake device. The safety brake devices 26 are in general activated by a speed limiter when a predetermined trigger speed is exceeded by the multi-deck vehicle. However, the present invention is not to be restricted to a specific form of construction, number or arrangement of the safety brake devices 26 for the multi-deck vehicle 10.

A second exemplifying embodiment of the present invention is now explained in more detail with reference to FIG. 2. In that case, the same and similar components are characterized by the same reference numerals as in the first exemplifying embodiment and a repeated description of the constructions and modes of function thereof is dispensed with. An elevator installation comprising a multi-deck vehicle 10 with an upper, first car 12 and a lower, second car 14 is again illustrated. However, in this form of embodiment as well the multi-deck vehicle can comprise more than two cars.

In the exemplifying embodiment shown in FIG. 2 the support means 16 is guided by way of deflecting pulleys 27, which are mounted below the lower, second car 14 and on this car, in order to support and drive the car 14 and, by this, the entire multi-deck vehicle 10. The support means and thus the multi-deck vehicle 10 are driven by the drive 18. A drive concept, which is known per se, with a 2:1 suspension is realized by the illustrated support means arrangement. A 2:1 suspension is obviously also capable of realization in that such deflecting pulleys are mounted above the uppermost car of a multi-deck vehicle. The support means 16 usually also co-operates in known manner with a counterweight which, however, is not illustrated in FIG. 2.

Figure 2:
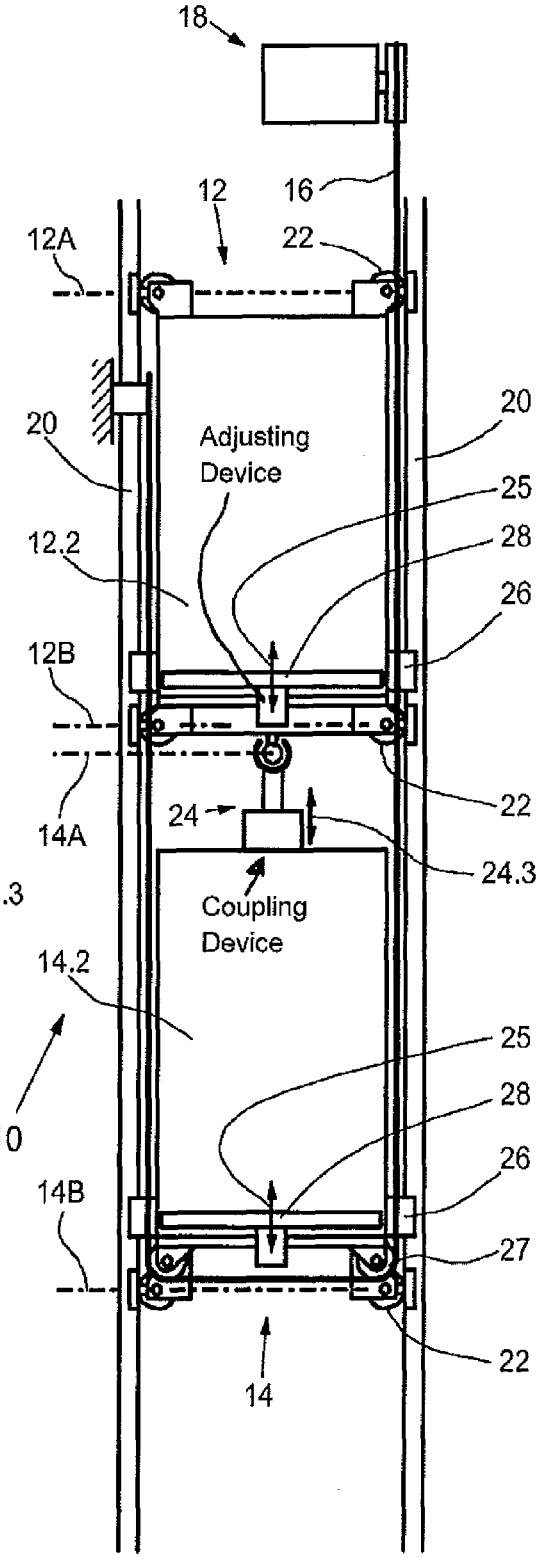
FIG. 2 shows a schematic illustration of an elevator installation with a multi-deck vehicle according to a second exemplifying embodiment of the present invention.

The exemplifying embodiment according to FIG. 2 differs from the elevator installation illustrated in FIG. 1 particularly also by the form of guidance of the cars 12, 14 of the multi-deck vehicle 10. As shown in FIG. 2, in the case of this form of embodiment an upper car 12 of the multi-deck vehicle 10 is provided in at least two guide planes 12A, 12B, which are spaced from one another in the direction of movement of the multi-deck vehicle, with guide elements 22 which guide this upper car 12 at the guide rails 20 in its two guide planes independently of guide elements of further guide planes of the multi-deck vehicle. A lower car 14, which is arranged below the upper car 12, of the multi-deck vehicle 10 has a first (upper) guide plane 14A, in which no guide elements are present. However, the lower car 14 is guided in the region of its first (upper) guide plane 14A at the adjacent first car 12 of the multi-deck vehicle. The second car 14 is provided in a second (lower) guide plane 14B, which is spaced from the first (upper) guide plane 14A in the direction of movement of the multi-deck vehicle, with guide elements 22 which guide the car at the guide rails 20 in this second guide plane independently of guide elements of further guide planes of the multi-deck vehicle. The afore-mentioned guidance of the second car 14 at the first car 12 is effected by a coupling device 24 connecting the two cars 12, 14. This coupling device is rigidly connected on its lower side with the lower car 14 and pivotably connected on its upper side with the upper car 12. The coupling device 24 obviously also serves for transmission of the supporting and driving forces which in the form of embodiment according to FIG. 2 are transmitted to the upper car 12 from the lower car 14 supported by the support means 16.

In a case of a multi-deck vehicle 10 in the form of embodiment according to FIG. 2, which comprises more than two cars, the uppermost car 12, for example, is equipped in two guide planes with guide elements 22, whilst all further cars respectively comprise guide elements 22 which co-operate with the guide rails in only a single guide plane and which are mounted in the region of the car floor thereof. In this case, in their second guide plane lying in the region of their car ceiling all further cars are guided by means of a coupling device 24 at the car respectively lying thereabove.

A multi-deck vehicle 10 according to the invention can also be constructed so that the lowermost car is guided in two guide planes and that all further cars have in the region of their car ceilings a respective guide plane with guide elements which co-operate with the guide shoes. In this case, all further cars are guided in their second guide plane, which lies in the region of the car floor, by means of a coupling device 24 at the car respectively lying thereunder.

The coupling device 24 is rigidly connected by one of the respectively coupled cars 12, 14, whilst its connection with the other car is executed as an articulated coupling. It is thereby ensured that the coupling device transmits forces only in the direction of the movement of the multi-deck vehicle 10 so that the guide elements of the respectively coupled cars do not influence one another.

By contrast to the cars, which are illustrated in FIG. 1, of the multi-deck vehicle 10 the cars in the form of embodiment according to FIG. 2 do not have a safety frame. The guide elements 22 and also the safety brake devices 26 are directly mounted on the car bodies 12.2, 14.2 of the cars 12, 14. The car bodies 12.2, 14.2 of these cars are therefore constructed as a self-supporting construction with sufficient stability.

In the case of a multi-deck vehicle 10 in the form of embodiment according to FIG. 2 the at least one coupling device 24 can also comprise an adjusting device 24.3 which enables automatic adjustment of the spacing between adjacent cars 12, 14 of the multi-deck vehicle in order to adapt the spacing between the floor levels of the cars to different floor spacings of a building.

As an alternative to the afore-described adjusting device 24.3 forming part of the coupling device 24 the cars 12, 14 of the multi-deck vehicle 10 can, as shown in FIG. 2, comprise a car floor 28 adjustable in the direction of movement of the multi-deck vehicle, wherein the adjustment is preferably carried out by means of an adjusting device 25 (illustrated symbolically by arrow 25) which is preferably driven by a motor and controlled by an elevator control. The level of the car floor of the car 12, 14 can also be automatically adapted by such a device to the threshold level of an access point—which the car is opposite at a specific point in time—to the elevator.

The remaining features and modifications correspond with those of the above-explained first exemplifying embodiment according to FIG. 1.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation with a multi-deck vehicle having at least two cars, connected by a coupler, for transporting persons and/or goods and which is movable by a drive and a support device along guide rails arranged at side walls of an elevator shaft, comprising:

a first car of the at least two cars of the multi-deck vehicle having at least two associated guide planes, which at least two guide planes are spaced apart in a direction of movement of the multi-deck vehicle, with first guide elements that guide said first car at the guide rails in the at least two guide planes; and a second car of the at least two cars of the multi-deck vehicle is guided in an associated first guide plane at the first car and is provided in an associated second guide plane, which second guide plane is spaced from the first guide plane in the direction of movement of the multi-deck vehicle, with second guide elements that guide said second car in the second guide plane at the guide rails independently of the first guide elements and the first guide elements guide said first car independently of the second guide elements;

wherein the coupler is a coupling device and is configured for a pivotable connection with at least one of the cars such that only supporting and drive forces applied to one of the cars in the direction of movement of the multi-deck vehicle are transmitted between the cars, wherein said first and second cars of the multi-deck vehicle are connected together by said coupling device which includes a joint by which said coupling device is connected with at least one of said first and second cars of the multi-deck vehicle, and said coupling device is pivotably connected on an upper end with one of the first and second cars and is rigidly connected on a lower end with another of said first and second cars.

2. The elevator installation according to claim 1 wherein each of said first and second cars is guided in the associated guide planes at the guide rails exclusively by said guide elements associated with the associated guide planes.

3. The elevator installation according to claim 1 wherein a spacing is present in the direction of movement of the multi-deck vehicle between said first and second cars of the multi-deck vehicle, which spacing is settable by a motor-operated and controllable adjusting device integrated in said coupling device.

4. The elevator installation according to claim 1 wherein at least one of said first and second cars of the multi-deck vehicle includes a car floor adjustable in the direction of movement of the multi-deck vehicle and a motor-operated and controllable adjusting device for adjusting said car floor in the direction of movement.

5. The elevator installation according to claim 1 wherein at least one of said first and second cars of the multi-deck vehicle has a self-supporting construction, and wherein said guide elements associated with said at least one car are fixed to the self-supporting construction.

6. The elevator installation according to claim 1 wherein at least one of said first and second cars of the multi-deck vehicle is provided with a least one safety brake device.

7. The elevator installation according to claim 6 wherein each of the at least two cars of the multi-deck vehicle is provided with at least one safety brake device.

8. The elevator installation according to claim 1 wherein the support device directly supports and drives one of said first and second cars of the multi-deck vehicle, and wherein another one of said first and second cars of the multi-deck vehicle is coupled by said coupling device with the one of said first and second cars supported by the support device.

9. An elevator installation with a multi-deck vehicle having at least two cars, connected by a coupler, for transporting persons and/or goods and which is movable by a drive and a support device along guide rails arranged at side walls of an elevator shaft, comprising:

an uppermost car of the multi-deck vehicle having at least two associated guide planes, which at least two guide planes are spaced apart in a direction of movement of the multi-deck vehicle, with first guide elements that guide said uppermost car at the guide rails in the at least two guide planes;

a lowermost car of the multi-deck vehicle guided in an associated third guide plane, which is spaced from the guide planes of said uppermost car, with second guide elements that guide said lowermost car in the third guide plane at the guide rails independently of the first guide elements and the first guide elements guide said uppermost car independently of the second guide elements; and the coupler being a coupling device connecting said uppermost and lowermost cars, which said coupling device includes a pivotable joint by which said coupling device is connected with one of said uppermost and lowermost cars, said pivotable joint configured such that only supporting and drive forces applied to one of said uppermost and lowermost cars in the direction of movement of the multi-deck vehicle are transmitted between the cars, wherein said coupling device is pivotably connected on an upper end with said upper most car and is rigidly connected on a lower end with said lowermost car.

10. The elevator installation according to claim 9 wherein a spacing is present in the direction of movement of the multi-deck vehicle between said uppermost and lowermost cars, which spacing is settable by a motor-operated and controllable adjusting device integrated in said coupling device.

11. The elevator installation according to claim 9 wherein at least one of said uppermost and lowermost cars includes a car floor adjustable in the direction of movement of the multi-deck vehicle and a motor-operated and controllable adjusting device for adjusting said car floor in the direction of movement.

12. The elevator installation according to claim 9 wherein at least one of said uppermost and lowermost cars has a self-supporting construction, and wherein said guide elements associated with said at least one car are fixed the self-supporting construction.

13. The elevator installation according to claim 9 wherein at least one of said uppermost and lowermost cars is provided with a least one safety brake device.

14. The elevator installation according to claim 9 wherein the support device directly supports and drives one of said uppermost and lowermost cars.

* * * * *